United States Patent [19]

Westgate

[11] Patent Number: 4,700,410

[45] Date of Patent: Oct. 20, 1987

[54] PNEUMATIC ADJUSTMENT MEANS FOR EARCUPS IN HELMETS

[75] Inventor: Charles A. Westgate, Uniondale, Pa.

[73] Assignee: Gentex Corporation, Carbondale, Pa.

[21] Appl. No.: 884,099

[22] Filed: Jul. 10, 1986

[51] Int. Cl.[4] ..... A42B 3/00

[52] U.S. Cl. ..... 2/423; 2/6; 2/209; 2/DIG. 3

[58] Field of Search ..... 2/423, 209, 6, 10, 410, 2/DIG. 3, DIG. 6; 179/156 R

[56] References Cited

U.S. PATENT DOCUMENTS

| | | | |
|---|---|---|---|
| 3,091,771 | 6/1963 | Bixby | 2/423 |
| 3,562,811 | 2/1971 | Allen | 2/423 |
| 3,621,488 | 11/1971 | Gales | 2/209 X |
| 3,864,756 | 2/1975 | Desimone | 2/209 X |
| 3,866,243 | 2/1975 | Morgan | 2/413 X |
| 3,943,572 | 3/1976 | Aileo | 2/423 X |

*Primary Examiner*—Peter Nerbun

*Attorney, Agent, or Firm*—Shenier & O'Connor

[57] ABSTRACT

A protective helmet assembly in which a manually operable pump carried by the helmet outer shell is accessible from outside the shell to inflate two inflatable bodies disposed between the shell and respective sound-attenuating earcup subassemblies suspended from the shell adjacent to the wearer's ears. An element accessible from outside the shell can be actuated to deflate the inflatable bodies when the helmet assembly is doffed.

10 Claims, 6 Drawing Figures

FIG. 3
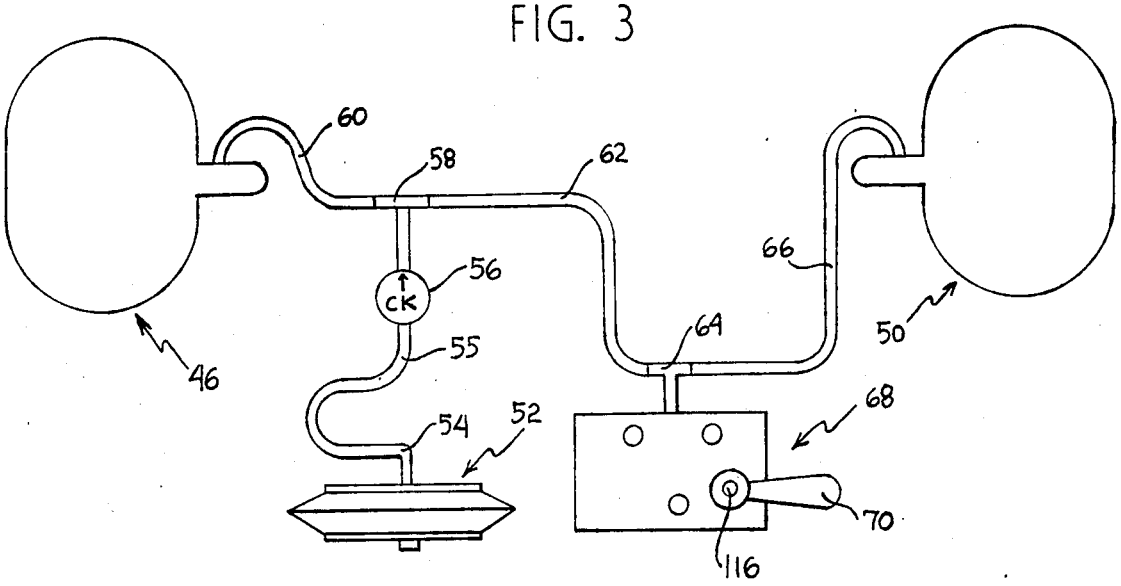
FIG. 4
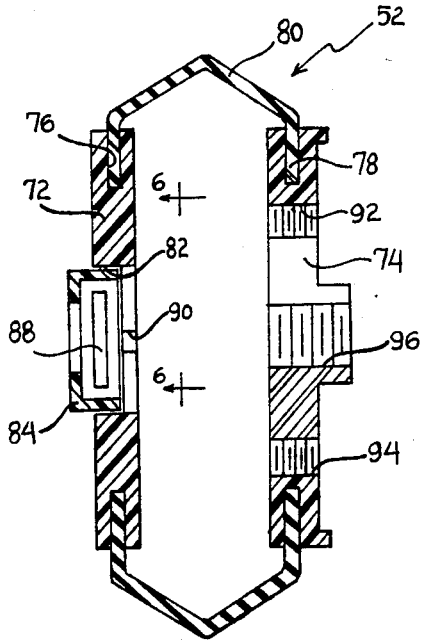
FIG. 5
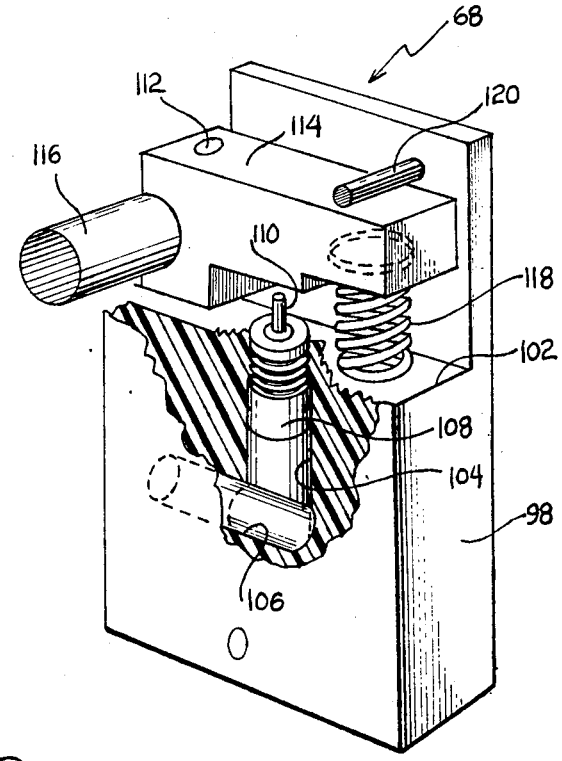
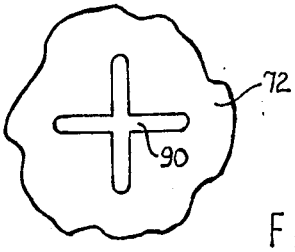
FIG. 6

PNEUMATIC ADJUSTMENT MEANS FOR EARCUPS IN HELMETS

FIELD OF THE INVENTION

The invention relates to protective helmet assemblies including sound-attenuating subassemblies and more specifically to an improved arrangement for adjusting the earcup subassemblies relative to the wearer's head.

BACKGROUND OF THE INVENTION

There are known in the prior art protective helmet assemblies including relatively hard outer shells from which sound-attenuating earcup assemblies are suspended in proximity to the wearer's ear. These earcup subassemblies are made up of hard earcups provided with soft annular seals around the edges thereof for forming a seal around the ear of the wearer's head. The earcup volume and the seals have been carefully designed to attenuate ambient noise which enters the hard outer shell through the bottom thereof. Providing adequate sound attenuation in respect of ambient noise is particularly important in an environment such as that of a combat vehicle wherein the crew members must be able to communicate effectively and efficiently. It will readily be apparent that high noise levels not only are distracting and fatiguing, but in the absence of adequate attenuation may interfere with effective communication.

In order to maintain an effective seal between the wearer's head and the earcup subassembly a force must be applied to the earcup. Various suggestions have been advanced in the prior art for accomplishing this result. Most of the mechanisms rely on some direct mechanical pressure to ensure a tight seal between the earcup assemblies and the wearer's head. Such arrangements do not always provide even application of pressure with the result that the sound-attenuation is not as effective as is desired and the wearer is subject to discomfort.

Various methods of effecting the sealing described hereinabove have been employed. In one arrangement in which the earcup subassemblies are supported in a fabric assembly, a chin strap is tightened to pull the earcup assemblies into engagement with the wearer's head. Alternatively, layers of foam have been inserted between the helmet shell and the earcup. In another method a resilient strap or spring applies pressure directly to the earcup. All of these methods of the prior art involve a trial and error adjustment which requires that the helmet must be taken off and put back on a number of times until a proper fit is accomplished. This is in addition to the defects of direct pressure application discussed hereinabove.

SUMMARY OF THE INVENTION

One object of my invention is to provide a protective helmet assembly with an improved earcup adjustment.

Another object of my invention is to provide an improved protective helmet assembly with an earcup adjustment arrangement which provides a positive adjustment yet is comfortable.

A further object of my invention is to provide a protective helmet assembly with an improved earcup adjustment which facilitates donning and doffing of the assembly.

Yet another object of my invention is to provide a protective helmet assembly with an improved earcup adjustment without increasing the weight of the assembly over that provided with adjustment means of the prior art.

A still further object of my invention is to provide a protective helmet assembly with an improved earcup adjustment which permits the earcups to be tightened or loosened at any time without moving the assembly from the wearer's head.

Still another object of my invention is to provide a protective helmet assembly with an improved earcup adjustment which enhances the stability of the overall assembly.

A still further object of my invention is to provide a protective helmet assembly with an improved earcup adjustment which accommodates a range of head sizes.

Other and further objects of my invention will appear from the following description.

BRIEF DESCRIPTION OF THE DRAWINGS

In the accompanying drawings which form part of the instant specification and which are to be read in conjunction therewith and in which like reference numerals are used to indicate like parts in the various views:

FIG. 3 is a plan illustrating the components of the earcup adjusting arrangement of the assembly shown in FIG. 1.

FIG. 4 is a sectional view of the pump of the earcup adjustment mechanism illustrated in FIG. 3.

FIG. 5 is a perspective view with parts broken away and with other parts shown in section of the relief valve of the adjustment arrangement illustrated in FIG. 3.

FIG. 6 is a fragmentary elevation taken along the line 6—6 of FIG. 4 to illustrate a detail of the pump shown in FIG. 4.

DESCRIPTION OF THE PREFERRED EMBODIMENT

Figure 1:
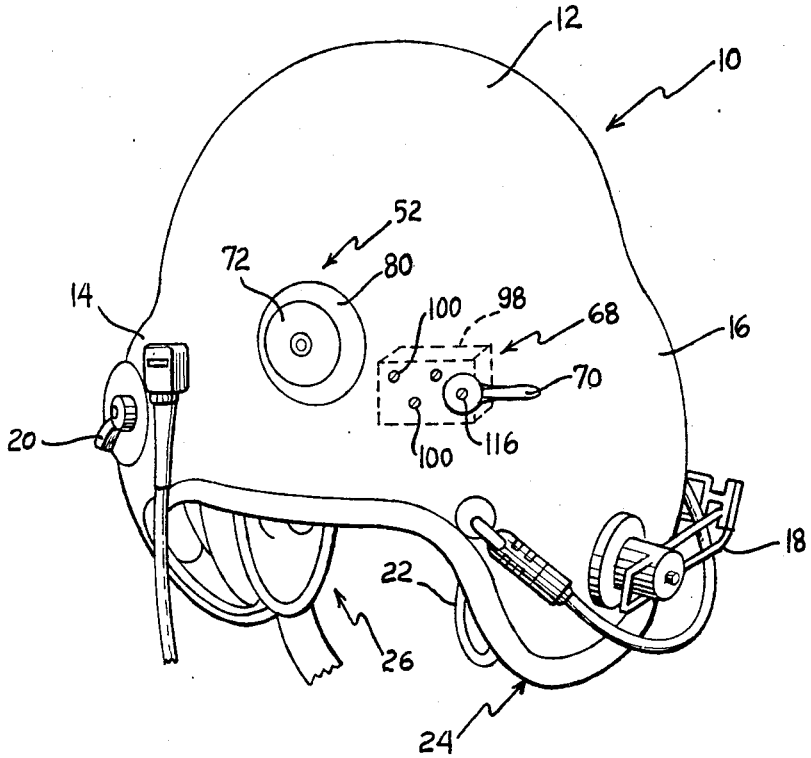
FIG. 1 is a perspective view from the rear of a protective helmet assembly incorporating my improved arrangement for adjusting the earcups.

Referring now to the drawings, a protective helmet assembly indicated generally by reference character 10 which may be provided with my improved earcup adjusting mechanism includes a hard outer shell 12 formed with a pair of sound-attenuating earcup subassembly receiving portions 14 and 16. The shell 12 may, for example, support a microphone boom 18 as well as a switch 20 adapted to be actuated to vary the communication arrangement provided for the wearer of the helmet.

An interior suspension 22 of a type known in the art is adapted to support a right-hand sound-attenuating earcup subassembly indicated generally by the reference character 24 and a left-hand sound-attenuating earcup subassembly indicated generally by the reference character 26.

Figure 2:
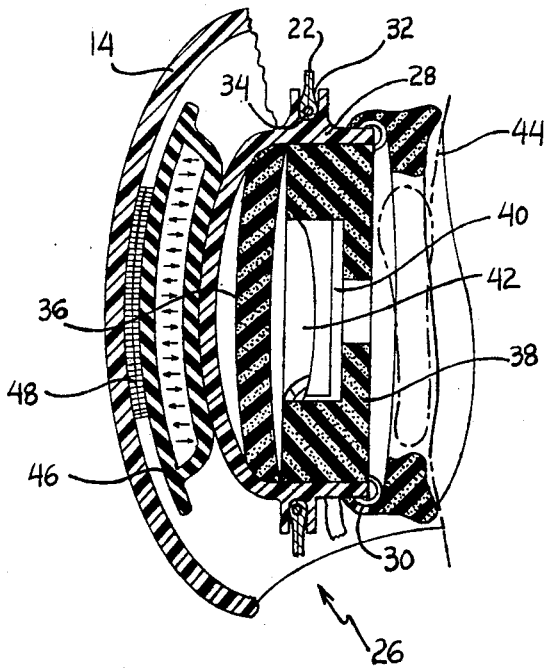
FIG. 2 is a fragmentary sectional view of the assembly shown in FIG. 1 illustrating one of the sound-attenuating earcup assemblies and its associated adjusting means.

Referring now to FIG. 2, I will describe only the left-hand sound-attenuating earcup subassembly 26 in detail, since the subassembly 24 is substantially the same. The assembly 26 includes a relatively rigid sound-attenuating earcup 28, the inner edge of which carries a curved peripheral flange 30. A cup 28 is provided with an exterior annular groove 32 formed between a pair of annular ribs or the like. The suspension 22, which is secured to the outer shell 12 in a manner known to the art, is formed with an opening 34 for receiving the cup 28 with the portion of the suspension 22 surrounding the opening 34 being received in the groove 32. The details of the suspension 22 may be seen, for example, in U.S. Pat. No. 3,789,427.

The cup 28 receives a pair of foam rubber pads 36 and 38 which serve to house an earphone 42 or the like forming part of the communication system of the assembly 10. More specifically, the pad 38 is formed with a recess 40 which receives the earphone 42 while the pad 36 is disposed over the recess outboard of the earphone 42. The sound-attenuating earcup subassembly is completed by an annular contoured pad 44 adapted to be moved into engagement with the wearer's head around his ear.

My improved earcup adjusting mechanism includes an inflatable bladder 46 disposed between the outside of the cup 28 and the inner surface of the ear portion 14. Preferably, I employ releasable Velcro fasteners or the like to secure the bladder 46 to the inside surface of the portion 14.

Referring now to FIG. 3, the pneumatic system of my improved earcup adjusting arrangement includes the bladder 46 and a second bladder 50 disposed between the outside of the cup 28 of the assembly 24 and the inner surface of the ear portion 16 of the helmet shell 12. A manually operable bellows pump indicated generally by the reference character 52, to be described in detail hereinbelow, is adapted to be operated to supply air under pressure to the interior of the two bladders 46 and 50. A fitting 54 connects the outlet of the pump 52 to a line 55 containing a check valve 56. A T 58 connects line 55 to a line 60 leading to the interior of the bladder 46. The other arm of the T 58 is connected to a line 62 feeding one arm of a T 64, the other arm of which is connected by a line 66 to the interior of the bladder 50. A relief valve assembly, indicated generally by the reference character 68 to be described in detail hereinbelow, includes an operating element 70 adapted to be actuated to connect the interiors of the bladders 46 and 50 to the atmosphere in a manner to be described.

Referring now to FIGS. 4 and 6, the bellows pump 52 includes an actuating plate 72 and a mounting plate 74. The peripheries of the plates 72 and 74 are formed with respective annular grooves 76 and 78 which receive the edges of a bellows 80 formed of a suitable resilient material. A recess 82 in the plate 72 receives a valve housing 84 which is secured therein by any suitable means known to the art, such for example as adhesive. Housing 84 is formed with an opening 86 which permits air to move into the bellows 80 when it expands. This air flows into the bellows through a cross-shaped recess 90 in the base of the plate 72. A valve 88 within the housing 84 is adapted to seat over the opening 86 to prevent air from flowing out of the bellows when plate 72 is moved toward plate 74 to inflate the bladders 46 and 50 through the check valve 56. I provide the plate 74 with two or more holes 92 and 94 by means of which it may be screwed onto the shell 12. A central threaded opening 96 receives the fitting 54 to permit air pumped out by the bellows to be fed to the bladders 46 and 50.

Referring now to FIG. 5, the relief valve assembly 68 includes a block 98 formed of a suitable synthetic resin and adapted to be mounted on the inside of the shell 12 by any suitable means, such for example as screws 100. I form the block 98 with a groove 102 and with a pair of intersecting bores 104 and 106, the bore 104 of which connects the base of recess 102 to the bore 106 and the bore 106 of which connects bore 104 to the T 64.

A pin 112 secures the valve operating member 114 to a shaft 116 rotatably supported in the walls of the block 98 defining the slot 102. A spring 118 biased between the base of the slot 102 and the end of the operating arm 114 remote from shaft 116 urges the arm away from the element 110 to a position against a limit stop pin 120. Shaft 116 extends outwardly through the shell 12 to receive the crank 70.

It is to be understood that I mount the block 98 in a position on the shell 12 at which the crank 70 is immediately accessible to the index finger of a person grasping the shell portion 16 in the act of doffing the helmet.

In operation of my improved earcup adjusting mechanism provided on the helmet assembly 10, before the assembly is donned the bladders 46 and 50 are deflated. After the wearer has placed the helmet assembly on his head with the sound-attenuating earcup subassemblies 24 and 26 adjacent to his ears, he operates the pump 52 to supply air under pressure to the bladders 46 and 50 to inflate them to such an extent that the pads 44 of the assemblies 24 and 26 are comfortably pressed against his head around his ears so as to form effective seals with his head. In the course of wearing the helmet, he may readily adjust the pressure of subassemblies 24 and 26 against his head without doffing the helmet by selectively operating the pump 52 and the relief valve assembly 68.

When the wearer wishes to doff the helmet he grasps the shell portions 14 and 16 in the usual manner. In so doing the crank 70 is immediately accessible to the index finger of his right hand. He then operates the crank to rotate shaft 116 to cause the arm 114 to move against the action of spring 118 into engagement with the element 110 to open the valve 108 to permit air to flow out of the bladders 46 and 50 to permit him to doff the helmet assembly without difficulty.

It will be seen that I have accomplished the objects of my invention. I have provided a protective helmet assembly with an improved mechanism for adjusting the sound-attenuating earcup subassemblies. My earcup adjusting mechanism provides effective seals with the wearer's head while at the same time being comfortable. My earcup adjusting mechanism facilitates quick donning and doffing of the protective helmet. It enables the wearer to adjust the pressure of the earcup assembly without doffing the helmet. It promotes the stability of the entire helmet system. It accommodates a range of head sizes.

It will be understood that certain features and subcombinations are of utility and may be employed without reference to other features and subcombinations. This is contomplated by and is within the scope of my claims. It is further obvious that various changes may be made in details within the scope of my claims without departing from the spirit of my invention. It is, therefore, to be understood that my invention is not to be limited to the specific details shown and described.

Having thus described my invention, what I claim is:

1. A protective helmet assembly including in combination a relatively rigid outer shell, a sound-attenuating earcup subassembly comprising a relatively rigid earcup, means carried by said outer shell for supporting said earcup subassembly in proximity to a wearer's ear when said helmet assembly is on the wearer's head, inflatable means disposed between said outer shell and said earcup adapted to be inflated to urge said earcup subassembly toward the wearer's head, a manually operable pump having an operating element adapted to be actuated to inflate said inflatable means, means mounting said pump on said outer shell with the pump operating element accessible from outside said shell and a manually operable relief valve having an operating element adapted to be actuated to deflate said inflatable means and means mounting said relief valve on said outer shell with the valve operating element accessible from outside said shell.

2. A protective helmet assembly as in claim 10 in which said outer shell is formed with a portion for receiving said earcup subassembly and in which said relief valve mounting means positions said valve actuating element at a location at which it is accessible to the hand of a wearer grasping said shell portion when doffing said helmet.

3. A protective helmet assembly as in claim 1 in which said inflatable means is a bladder, said assembly including manually releasable means for securing said bladder to the inside of said shell outboard of said earcup subassembly.

4. A self-contained protective helment and sound-attenuating earcup and earcup adjusting assembly including in combination, a relatively rigid outer shell formed with a pair of ear portions, said shell adapted to fit over the wearer's head, a pair of sound-attenuating earcup subassemblies each having a relatively rigid earcup and a seal adapted to be brought into engagement with the wearer's head, means for suspending said earcup assemblies within said shell adjacent to said ear portions for movement toward and away from the wearer's head, respective inflatable bodies disposed between said ear portions and said earcups adapted to be inflated to urge said seals into engagement with the wearer's head, a manually operable pump comprising an actuating element and an outlet passag, means mounting said pump on said shell with said actuating element outside said shell and with said outlet passage opening to the inside of said shell, means within said shell for connecting said outlet passage to said inflatable bodies, a relief valve having an operating element adapted to be actuated to deflate said inflatable bodies, and means mounting said relief valve on said shell with said operating element outside said shell at a location adjacent to one of said ear portions at which it is accessible to a wearer doffing said helmet assembly.

5. A self-contained helmet and sound-attenuating earcup and earcup adjusting assembly including in combination, a hard outer shell adapted to fit over the wearer's head, a sound-attenuating earcup subassembly comprising a seal adapted to be brought into engagement with the wearer's head, means carried by said outer shell for supporting said earcup subassembly in proximity to the wearer's ear when said hard outer shell is no the wearer's head, inflatable means disposed between the shell and the earcup subassembly adapted to be infated to urge said seal into engagement with the wearer's head, a manually operable pump comprising an actuating element and an outlet passage, means mounting said pump on said outer shell with said actuating element outside said shell and with said outlet passage opening to the inside of said shell, means within said shell for connecting said outlet passage to said inflatable means, a manually operable relief valve assembly comprising a normally closed relief passage and an actuating element adapted to be operated to open said relief passage, means mounting said relief valve assembly on said shell with the relief valve actuating element accessible from outside said shell and means connecting said relief passage to said inflatable means.

6. An assembly as in claim 5 in which said relief valve comprises a body forming said relief passage, a normally closing valve in said passsage, an arm, means mounting said arm on said body for movement between a first position at which it opens said valve and a second position, means biasing said arm to said second position, said relief valve assembly mounting means mounting said body inside said shell, said arm mounting comprising a shaft, said shaft extending through said shell, said relief valve actuating element comprising a crank carried by said shaft outside said shell.

7. An assembly as in claim 6 in which said pump comprises a first plate forming said outlet passage, a second plate forming said actuating element and a bellows connecting said plates, said second plate formed with an inlet opening for admitting air into said bellows and a check valve in said inlet opening.

8. An assembly as in claim 5 in which said pump comprises a first plate forming said outlet passage, a second plate forming said actuating element and a bellows connecting said plates, said second plate formed with an inlet opening for admitting air into said bellows and a check valve in said inlet opening.

9. A self-contained protective helmet and sound-attenuating earcup and earcup adjusting assembly including in combination, a relatively rigid outer shell formed with a pair or ear portions, said shell adapted to fit over the wearer's head, a pair of souond-attenuating earcup subassemblies each having a relatively rigid earcup and a seal adapted to be brought into engagement with the wearer's head, means for suspending said earcup assemblies within said shell adjacent to said ear portions for movement toward and away from the wearer's head, respective inflatable bodies disposesd between said ear portions and said earcups adapted to be inflated to urge said seals into engagement with the wearer's head, a manually operable pump comprising an actuating element and an outlet passage, means mounting said pump on said shell with said actuating element outside said shell and with said outlet passage opening to the inside of said shell, means within said shell for connecting said outlet passage to said inflatable bodies, a manually operable relief valve assembly comprising a normally closed relief passsage and an actuating element adapted to be operated to open said relief passage, means mounting said relief valve assembly on said shell with the relief valve actuating element accessible from outside said shell and means connecting said relief passage to said inflatable bodies.

10. An assembly as in claim 9 in which said pump comprises a first plate forming said outlet passage, a second plate forming said actuating element and a bellows connecting said plates, said second plate formed with an inlet opening for admitting air into said bellows and a check valve in said inlet opening.

* * * * *

UNITED STATES PATENT AND TRADEMARK OFFICE

CERTIFICATE OF CORRECTION

PATENT NO. : 4,700,410

DATED : October 20, 1987

INVENTOR(S) : Charles A. Westgate

It is certified that error appears in the above-identified patent and that said Letters Patent are hereby corrected as shown below:

Col. 5, line 12, change "10" to --1--;

Col. 5, line 38, change "passag" to --passage--;

Col. 5, line 56, change "no" to --on--;

Col. 6, line 11, change "closing" to --closed--;

Col. 6, line 16, after "mounting" insert --means--;

Col. 6, line 35, change "or" to --of--;

Col. 6, line 36, change "souond" to --sound--.

Signed and Sealed this

Twenty-ninth Day of March, 1988

*Attest:*

*Attesting Officer*

DONALD J. QUIGG

*Commissioner of Patents and Trademarks*